US005451011A

United States Patent [19]

Frost et al.

[11] Patent Number: 5,451,011

[45] Date of Patent: Sep. 19, 1995

[54] ACCUMULATOR ASSEMBLY

[75] Inventors: Terry M. Frost; Daniel J. Schwartze, both of Spokane; Jennings A. Jones, Medical Lake, all of Wash.

[73] Assignee: ASC Machine Tools, Inc., Spokane, Wash.

[21] Appl. No.: 69,552

[22] Filed: May 28, 1993

[51] Int. Cl.[6] ..... B21C 47/16

[52] U.S. Cl. ..... 242/552; 242/559.4; 226/118

[58] Field of Search ..... 242/55, 78.6, 78.7, 242/78.8, 128, 552, 558, 559.4; 226/118, 119

[56] References Cited

U.S. PATENT DOCUMENTS

| | | | |
|---|---|---|---|
| 3,534,918 | 10/1970 | Clark | 242/55 |
| 3,561,691 | 2/1971 | Nichols et al. | 242/55 |
| 3,810,591 | 5/1974 | Haven | 242/78.6 |
| 3,888,400 | 6/1975 | Wiig | 226/118 X |
| 4,009,674 | 3/1977 | Ladd | 242/55 X |
| 4,058,270 | 11/1977 | Simmons et al. | 242/105 |
| 4,249,705 | 2/1981 | Brooks et al. | 242/78.6 |
| 4,290,561 | 9/1981 | Satzinger | 242/55 |
| 4,290,563 | 9/1981 | Brooks et al. | 242/78.6 |
| 4,489,872 | 12/1984 | Bolton et al. | 226/118 X |
| 4,582,271 | 4/1986 | Takahashi | 242/55 |
| 4,610,408 | 9/1986 | Box et al. | 242/78.6 |
| 4,770,366 | 9/1988 | Hood et al. | 242/78.6 X |
| 4,773,610 | 9/1988 | Nordlof | 242/78.6 |
| 4,844,360 | 7/1989 | Winter et al. | 242/55 |
| 4,848,694 | 7/1989 | Julian | 242/78.6 |
| 4,863,112 | 9/1989 | Summerauer et al. | 242/78.8 |
| 4,923,138 | 5/1990 | Malkin | 242/55 X |
| 4,979,692 | 12/1990 | Julian | 242/55 X |

*Primary Examiner*—John P. Darling
*Attorney, Agent, or Firm*—Bill D. McCarthy

[57] ABSTRACT

A vertical uncoiling apparatus having a frame assembly for supporting a coil of strip material and an accumulator assembly for selectively removing and delivering the strip material to downstream processing equipment. The accumulator assembly is provided with an accumulation loop area defining a substantially S-shaped travel path for the strip material and a feed assembly for removing strip material from the coil of strip material and feed same into the accumulation loop area so that a steady state flow of substantially tension-free strip material can be delivered to downstream processing equipment.

16 Claims, 3 Drawing Sheets

ACCUMULATOR ASSEMBLY

BACKGROUND OF THE INVENTION

1. Field of the Invention

The present invention relates to coil stock dispensing equipment, and more particularly, but not by way of limitation, to an improved accumulator assembly for providing a tension-free steady state supply of strip material to downstream processing equipment.

2. Brief Description of the Prior Art

Material such as steel and aluminum are often most efficiently processed with equipment, such as punch presses and the like, in the form of long, continuous webs or strips which are unwound from a coil. Apparatuses for uncoiling strip material from coils positioned either vertically or horizontally on the uncoiler are well known in the art. With horizontal uncoiling apparatuses, an accumulator is commonly positioned between the coil and the processing equipment to store a sufficient amount of strip material so that a steady-state flow of material is available to the processing equipment.

Accumulators used with horizontal uncoilers are, in essence, designed to form a slack loop in the strip material which provides a readily available supply of material for the processing equipment. Accumulators of this type have been used successfully for many years. However, problems have been encountered in that accumulators are often large in size in order to store a sufficient quantity of material, thus requiring a substantial amount of floor space in a manufacturing plant. In fact, some types of processing equipment require a pit in order to accommodate large material requirements. While accumulators can be used to provide processing equipment with an ample and relatively tension-free supply of strip material, such accumulators are nevertheless economically inefficient to operate in view of the high cost of floor space in a manufacturing plant and the inefficiency created by the immobility of the accumulator.

In recent years, larger coils which are more economical to purchase have been used by manufacturers. To reduce the handling problems associated with the larger and heavier coils, it is preferable to dispose the coils in an "eye to sky" or axial vertical position on a turntable. Attempts have been made to develop vertical uncoiling assemblies which do not utilize conventional accumulators, but instead use accumulator detection devices to control the rate at which the coil pays out material to the processing equipment. Such an uncoiling assembly is described in U.S. Pat. No. 4,770,366.

The problem with many of the prior art accumulators and uncoiling assemblies is that they are not operational with certain types of strip material. That is, many of the prior art accumulator detection devices will not satisfactorily handle light gauge strip material or deliver material to high speed processing equipment without damaging the material. These detection devices usually employ a dancer roller for contacting the material so as to place the material under tension and a variable speed control device that is activated by the strip material coming into contact with a control switch or other similar device. Problems are often encountered, however, in the use of accumulator detecting devices which require contact with the strip material. For example, in the processing of ductile or thin material, the material often becomes distorted beyond unacceptable tolerances because of the tensile forces applied to the material. Further, when processing prepainted or precoated coil strip material accumulator detecting devices requiring contact with the strip material often damage the preapplied finish.

Thus, there is a need for an accumulator for a uncoiler apparatus which requires a minimum amount of floor space and which will store a sufficient quantity of material for downstream processing equipment despite changes in the material demand, while at the same time functioning in a non-contact, tension-free manner. It is to such an accumulator that the present invention is directed.

SUMMARY OF THE INVENTION

The present invention provides an improved vertical uncoiling apparatus for providing strip material to downstream process equipment. Broadly, the vertical uncoiling apparatus includes a frame assembly for supporting and selectively removing strip material from a coil of the strip material and an accumulator assembly adapted to receive the strip material from the frame assembly. The accumulator assembly is provided with a feed assembly for feeding the strip material from the frame assembly into an accumulation area of the accumulator assembly so that a steady state flow of substantially tension free strip material can be withdrawn from the accumulator assembly by the downstream processing equipment. The accumulator assembly is further provided with an accumulation loop area defining a substantially S-shaped travel path for the strip material and includes a guide assembly adapted to provide an accumulation loop of the strip material in the accumulation area, while at the same time defining the substantially S-shaped travel path for the strip material through the accumulator assembly.

An object of the present invention is to provide an accumulator assembly capable of providing a tension-free steady state supply of strip material to downstream processing equipment.

Another object of the present invention, while achieving the above-stated object, is to provide an accumulator assembly capable of handling and delivering light gauge strip material to high speed processing equipment.

Still another object of the present invention, while achieving the above-stated objects, is to provide an accumulator assembly for an uncoiler apparatus which requires a minimum amount of floor space and which will store a sufficient quantity of strip material for downstream processing equipment.

Other objects, advantages and features of the present invention will become apparent upon reading of the following detailed description in conjunction with the appended claims.

DETAILED DESCRIPTION

Figure 1:
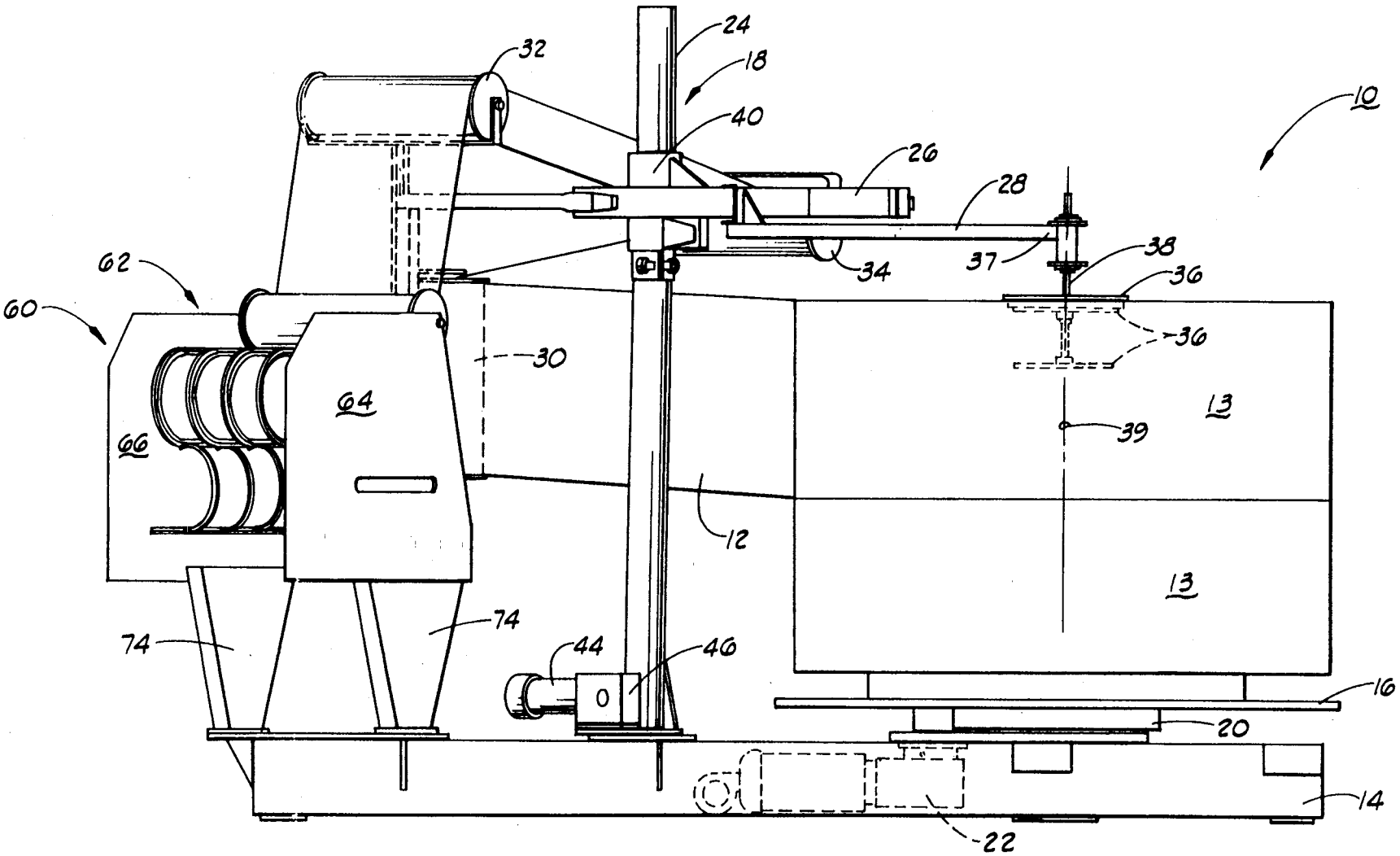
FIG. 1 is a perspective view of a vertical uncoiling assembly employing an accumulator assembly constructed in accordance with the present invention.

Referring now to the drawings, and more particularly FIG. 1, a vertical uncoiling assembly 10 for delivering a strip material 12 to downstream processing equipment (not shown), such as a punch press and the like, is illustrated. The vertical uncoiling assembly 10 is adapted to carry a plurality of vertically disposed coils 13 of the strip material 12 with the trailing end of the strip material 12 of the upper coil 13 attached to the leading end of the adjacently disposed lower coil 13.

The uncoiling assembly 10 includes a base frame 14 on which a turntable 16 and a mast and boom assembly 18 are supported. The turntable 16 is connected to a gear 20 which is driven by a variable speed brake motor 22. The mast and boom assembly 18 includes a mast 24, a first boom arm 26 and a second boom arm 28. As will be described in more detail hereinafter, the first boom arm 26 is slidably supported by the mast 24; and a second boom arm 28 is connected to the first boom arm 26. A series of spools or idler rollers and centering discs are attached to the first and second boom arms 26, 28. More specifically, a vertical idler roller 30 and a first horizontal idler roller 32 are attached at one end of the first boom arm 26, and a second horizontal idler roller 34 is attached at the other end of the first boom arm 26. A plurality of centering discs 36 are rotatably connected to a distal end 37 of the second boom arm 28 via a journalled shaft 38; and the second boom arm 28 is connected to the first boom arm 26 such that the centering discs 36 are aligned with a vertical axis of rotation 39 of the turntable 16 and extend into the uppermost disposed coil 13 of the strip material 12.

Figure 2:
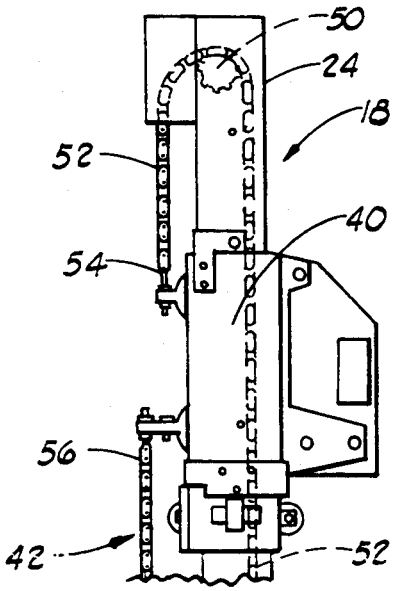
FIG. 2 is a fragmental, side elevational view of a mast and boom assembly of the vertical uncoiling assembly of FIG. 1.
Figure 2:
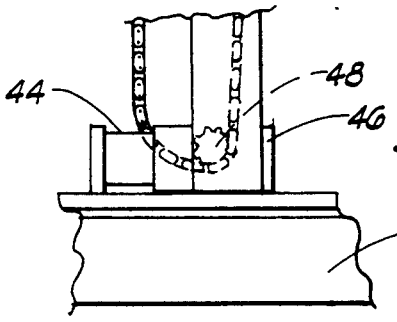

The first boom arm 26 is slidably connected to the mast 24 by a boom collar 40 so that the height of the first boom arm 26, and thus the height of the vertical idler roller 30, the first and second horizontal idler rollers 32, 34 and the second boom arm 28, can be vertically adjusted. The boom collar 40 is vertically movable along the mast 24 by a chain and sprocket assembly 42 as shown in FIG. 2.

The chain and sprocket assembly 42 comprises a motor 44, a gearbox 46 having a driver sprocket 48 connected to an output shaft (not shown), a driven sprocket 50 journally connected to the mast 24, and a chain member 52 having a first end 54 and a second end 56. The first and second ends 54, 56 of the chain member 52 are connected to the boom collar 40 so that the chain member 52 extends around the driver sprocket 48 and the driven sprocket 50. Thus, upon activation of the motor 44, the boom collar 40 can be selectively moved along the mast 24 to raise the centering discs 36 during the loading of the coils 13 on the turntable 16; or, the boom collar 40 can be selectively moved along the mast 24 to lower the centering discs 36 into the upper coil 13 for paying out the strip material 12 from the coil 13.

To operate the vertical uncoiling assembly 10, one or more coils 13 of the strip material 12 is placed on the turntable 16 in an "eye to the sky" or vertical axial position and the first boom arm 26 is vertically positioned so that the centering discs 36 supported on the distal end 37 of the second boom arm 28 are disposed within the center of the upper coil 13 of the strip material 12. The strip material 12 is then threaded from the upper coil 13 over the vertical idler roller 30 and the first and second horizontal idler rollers 32, 34, substantially as shown in FIG. 1.

The vertical uncoiling assembly 10 further includes an accumulator assembly 60 for providing downstream processing equipment with a steady-state flow of the strip material 12 in a non-contact, tension-free manner. As more clearly shown in FIGS. 3 and 4, the accumulator assembly 60 is provided with a frame 62 having a pair of spatially disposed side plates 64, 66. The side plates 64, 66 are rigidly interconnected in a parallel relationship by a plurality of rigid cross members 68, 68A which transversely extend between the side plates 64, 66. The side plates 64, 66 are secured to the ends of the cross members 68, 68A in a suitable manner, such as with bolts 70, 70A, respectively, which extend through holes (not shown) in the side plates 64, 66 and threadingly engage the ends of the cross members 68, 68A. Each of the side plates 64, 66 is provided with a viewing slot, such as viewing slot 72 in the side plate 66 (FIG. 3), to enable an operator to view the strip material 12 as it travels through the accumulator assembly 60.

The frame 62 is elevated from the floor by a pair of support legs 74 so that as the strip material 12 travels through the accumulator assembly 60, the strip material 12 is in substantial alignment with the downstream processing equipment (not shown). The support legs 74 are desirably rigidly connected to the side plates 64, 66 of the frame 62 and to the base frame 14 of the vertical uncoiling assembly 10, substantially as shown in FIG. 1. However, it should be understood that the leg supports 74 can be secured to a separate base member so that the accumulator assembly 60 can be provided as a separate unit from the vertical uncoiling assembly 10.

Figure 3:
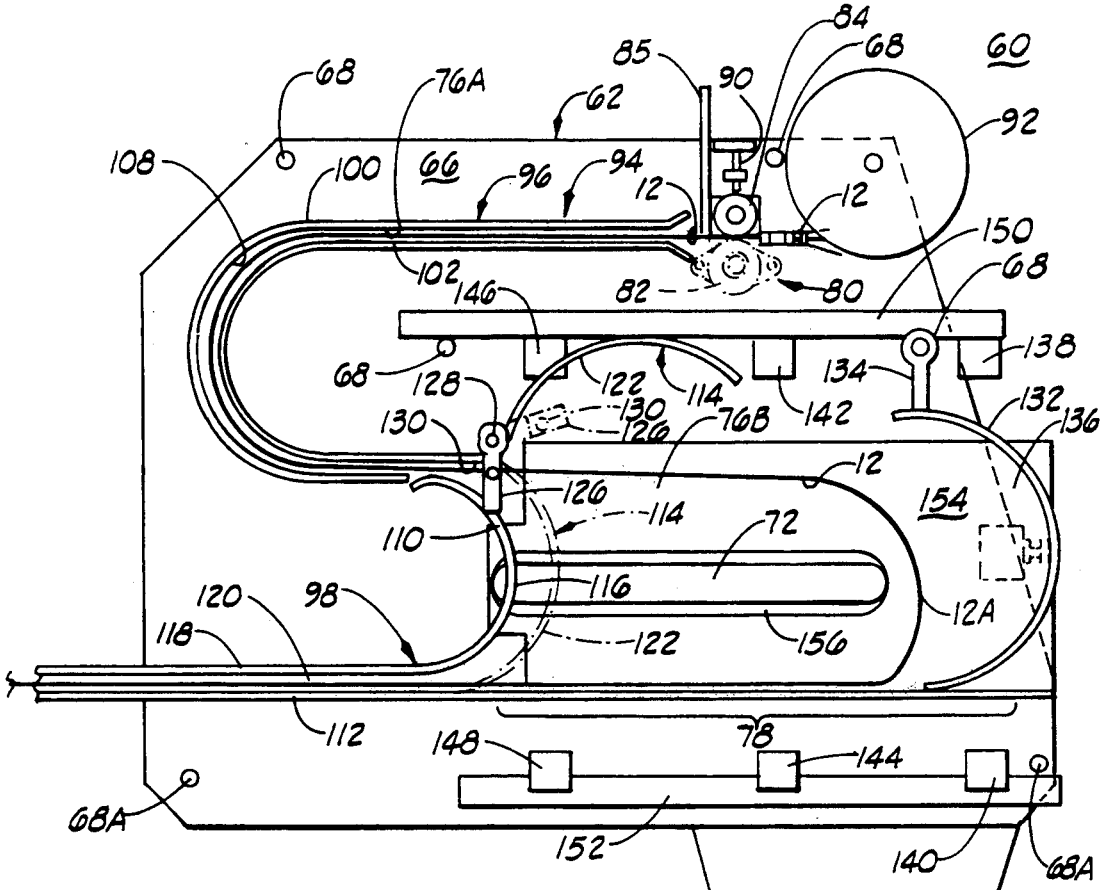
FIG. 3 is a side elevational view of the accumulator assembly of the present invention having a side plate removed therefrom for the sake of clarity.
Figure 3:
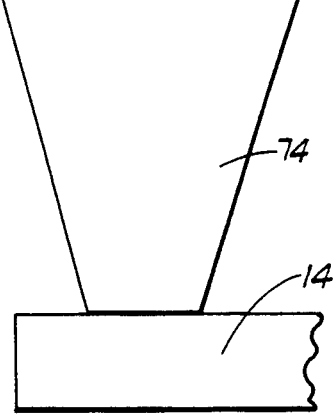

The strip material 12 travels through the accumulator assembly 60 in a substantially S-shaped pattern that includes an upper loop portion 76A and a lower loop portion 76B. Strip material 12 traveling through the lower loop portion 76B passes through an accumulator loop area 78 of the accumulator assembly 60 wherein the strip material 12 is substantially unconfined (FIG. 3). Thus, the lower loop portion 76B permits the strip material 12 to produce a free accumulation loop 12A as the strip material 12 fluctuates back and forth in a tension-free manner in the accumulator loop area 78 in response to changes in the material demand of the processing equipment. The manner in which changes in the size of the accumulation loop of the strip material 12 is used to control the pay out rate of the vertical uncoiling assembly 10 will be described hereinafter.

The strip material 12 is fed into the accumulator assembly 60 by a feed or pinch roller assembly 80. The feed roller assembly 80 includes a lower roller 82 and an upper roller 84, each of which is pivotally supported between the side plates 64, 66. The upper roller 84 is connected to a hand lever 85 so that during start-up the upper roller 84 can be raised relative to the lower roller 82 to enhance feeding of the strip material 12 through the feed roller assembly 80. The lower roller 82 is operably connected to a variable speed motor 86 through a gear box 88 (FIG. 4); and the upper roller 84 is spring biased to produce a gripping force between the lower and upper rollers 82, 84. The gripping force between the lower and upper rollers 82, 84 can be adjusted by rotation of a threaded collar 90. As will be described hereinafter, the speed of the lower roller 82 is controlled so as to be responsive to the material requirements of the downstream processing equipment.

The strip material 12 is fed to the lower and upper rollers 82, 84 of the pinch roller assembly 80 from an idler roller 92 pivotally mounted between the side plates 64 and 66. The idler roller 92 is positioned so that the strip material 12 is aligned with the slot formed between the lower an upper rollers 82, 84 when the strip material 12 comes off the idler roller 92. The strip material 12 is received by the idler roller 92 from the first horizontal idler roller 32, as shown in FIG. 1.

The strip material 12 travels through the accumulator assembly 60 along a substantially S-shaped travel path defined by a guide assembly 94 mounted between the side plates 64, 66 of the frame 62. The guide assembly 94 comprises an upper guide subassembly 96 and a lower guide subassembly 98. The upper guide subassembly 96 includes an outer guide 100 and an inner guide 102. The strip material 12 is illustrated in FIG. 3 traveling through the upper guide subassembly 96 without contacting the outer and inner guides 100, 102 for the sake of clarity. However, in operation of the accumulator assembly 60 the strip material 12 will be in sliding contact with the outer and inner guides 100, 102, as well as the lower guide subassembly 98.

The outer and inner guides 100, 102 can be constructed of any suitable material. However, it is preferable that the outer and inner guides 100, 102 be constructed of a plurality of parallel, spatially disposed relatively thin guide rods 104 interconnected by a plurality of cross bars 106 (FIG. 4) in such a manner so as to not impede the strip material 12 as it travels along the substantially S-shaped travel path defined by the guide assembly 94. That is, the cross bars 106 are positioned perpendicular to the guide rods 104 and attached thereto in a conventional manner, such as by welding or the like; and the outer and inner guides 100, 102 are connected to the side plates 64, 66 in a conventional manner so that the outer and inner guides 100, 102 extend between the side plates 64, 66 substantially as shown.

The outer and inner guides 100, 102 of the upper guide subassembly 96 are each provided with a substantially J-shaped configuration and cooperate to provide a substantially J-shaped slot 108 which defines the travel path for the strip material 12 through the upper guide subassembly 96. The upper guide subassembly 96 is positioned to receive the strip material 12 from the pinch roller assembly 80 and direct the strip material 12 along a linear travel path across an upper portion of the accumulator assembly 60. The upper guide subassembly 96 then directs the strip material 12 along a 180 degree curved travel path defined by the J-shaped slot 108. Thus, the upper guide subassembly 96 forms the upper loop portion 76A of the substantially S-shaped travel path for the strip material 12, and thereby guides the strip material 12 to the lower guide subassembly 98.

The lower guide subassembly 98 includes an inner guide 110, a base guide 112 and a pivotally mounted feed guide 114. The inner guide 110 and the base guide 112 are preferably constructed of a like material and in a like manner as the outer and inner guides 100, 102 of the upper guide subassembly 96. That is, the inner guide 110 and the base guide 112 are constructed of a plurality of guide rods spaced apart in a parallel relationship and interconnected with a plurality of cross bars. Furthermore, the inner guide 110 of the lower guide subassembly 98 is of a similar configuration as the inner guide 102 of the upper guide subassembly 96 in that it has a substantially J-shaped configuration which includes a curved portion 116 and a straight portion 118.

The inner guide 110 is positioned between the side plates 64, 66 such that one end of the inner guide 110 of the lower guide subassembly 98 is disposed adjacent one end of the outer guide 100 of the upper guide subassembly 96 substantially as shown in FIG. 3. The inner guide 110 defines the shortest path that the strip material 12 can travel around the lower loop portion 76B of the substantially S-shaped travel path, and thus also defines a downstream end of the accumulator loop area 78.

The base guide 112 has a relatively flat configuration and is positioned below the straight portion 118 of the inner guide 110 such that the base guide 112 runs parallel to the straight portion 118 of the inner guide 110 and cooperates with the straight portion 118 to form a slot 120 that defines an exit end portion of the substantially S-shaped travel path for the strip material 12. The base guide 112 further extends across the entire length of the frame 62 so as to provide a base support for the accumulation loop 12A in the accumulator loop area 78.

The feed guide 114 of the lower guide subassembly 98, which facilitates feeding the strip material 12 through the lower guide subassembly 98, comprises a pair of arcuate shaped first guide rod members 122 pivotally connected to the side plates 64, 66 so as to be disposed in a parallel, spatially disposed relationship with one another. The pivotal connection of the first guide rod members 122 to the side plates 64, 66 permits the first guide rod members 122 to be selectively movable between a first or down position (shown in phantom lines in FIG. 3), and a second or raised position (shown in bold lines in FIG. 3). In the lowered position the accurate configuration of the first guide rod members 122 permits the first guide rod members 122 to be disposed parallel to the curved portion 116 of the inner guide 110. Thus, in the lowered position the first guide rod members 122 function as an outer guide to guide the strip material 12 around the curved portion 116 of the inner guide 110 and into the slot 120 formed between the inner guide 110 and the base guide 112. However, when the processing equipment is in operation and the strip material 12 is passing through the accumulator assembly 60, the first guide rod members 122 of the feed guide 114 are locked in a raised position. Thus, the outer guide formed by the feed guide 114 is removed, thereby allowing the lower loop portion 76B of the strip material 12 that is, the accumulation loop 12A to move back and forth along the accumulator loop area 78 in response to the material demands of the downstream processing equipment.

To permit an operator to selectively rotate the first guide rod members 122 of the feed guide 114 between the raised position and a lowered position from the exterior side of the frame 62, a handle 126 is connected to one end of a rod member 128 employed to pivotally connect the first guide rod members 122 to the side plates 64, 66 of the accumulator assembly 60. One of the side plates (shown herein as side plate 66) is provided with a pair of holes (not shown) that are adapted to receive an indexing pin 130 supported by the handle 126. The holes (not shown) are located in the side plate 66 such that the first guide rod members 122 of the feed guide 114 can be locked in either the raised or lowered position by the indexing pin 130.

The feed guide 114 of the lower guide subassembly 98 further comprises a pair of arcuate shaped second guide rod members 132 connected to one of the cross members 68 via an extension or leg member 134 so that the second guide rod members 132 are disposed in parallel, spatially disposed relationship with one another at an upstream end 136 of the accumulator assembly 60.

Thus, the second guide rod members 132 function to define one end portion of the lower loop portion 76B of the accumulation loop of strip material 12 the accumulation loop 12A as the strip material 12 travels through the accumulator loop area 78.

The downstream processing equipment can consist of large progression processes or can be material feed rate intensive processes, thus resulting in the material demand requirements of the processing equipment changing continuously. Also, the pay out rate of the vertical uncoiling assembly 10 will vary as the coil 13 pays out strip material 12; that is, as the diameter of the coil 13 decreases, the rate at which material is paid out from the coil 13 also decreases. To maintain a steady-state supply of strip material 12 for the processing equipment, it is desirable that the accumulator assembly 60 be able to detect changes in the material demand of the downstream processing equipment and the pay out of the uncoiling assembly 10, and in turn, signal the vertical uncoiling assembly 10 to make the required pay out rate adjustments.

To provide a steady-state supply of the strip material 12 to downstream processing equipment without placing undesired tension on the strip material 12, the vertical uncoiling assembly 10 is provided with a plurality of photo cells to detect changes in the size of the accumulation loop 12A in the accumulation area 78. Each of the photo cells includes an emitter and a receiver, such as a low set-point emitter 138 and a low set-point receiver 140, a high set-point emitter 142 and high set-point receiver 144, and a no-loop eye emitter 146 and a no-loop receiver 148. The low set-point emitter 138, the high set-point emitter 142, and the no-loop emitter 146 are supported above the accumulator loop area 78 by support rods 150 so as to be positioned along the center axis of the accumulator assembly 60. In a like manner, the low set-point receiver 140, the high set-point receiver 144, and the no-loop receiver 148 are supported below the accumulator loop area 78 by support rods 152 so as to be positioned along the center axis of the accumulator assembly 60 and in alignment with their respective emitters 138, 142 and 146.

The low set-point emitter and receiver 138, 140 are positioned to detect a maximum accumulation loop 12A of strip material 12 in the accumulation loop area 78; whereas the high set-point emitter and receiver 142, 144 are positioned to detect a minimum accumulation loop 12A of strip material 12 in the accumulation loop area 78. Depending on the position of the accumulation loop 12A in the accumulator loop area 78, the low set-point and high set-point receivers 140, 144 provide signals to a controller (not shown) which adjusts the speed of the vertical uncoiling assembly 10 and pinch roller assembly 80 according to the material requirements of the downstream processing equipment. However, when the no-loop receiver 148 detects the absence of the accumulation loop of the strip material 12 in the accumulation loop area 78, the no-loop receiver 148 provides a signal to the controller whereupon the vertical uncoiling assembly 10 and the pinch roller assembly 80 are shut down and thus cease feeding the strip material 12 to the accumulator assembly 60.

To ensure that the strip material 12 is centered as it travels through the accumulator loop area 78, the accumulator assembly 60 further includes a pair of guide plates 154. Each of the guide plates 154 is configured to extend from the inner guide 110 of the lower guide subassembly 98 to the upstream end 136 of the accumulation loop area 78 which corresponds to the upstream end of frame 62. Further, each of the guide plates 154 is provided with a viewing slot 156 which is aligned with the viewing slots 72 formed in the side plates 64 and 66 when the guide plates 154 are properly positioned between the side plates 64 and 66. The alignment of the viewing slot 156 of one of the guide plates 154 with the viewing slots 72 of the side plate 66 is illustrated in FIG. 3.

The guide plates 154 are mounted along the accumulator loop area 78 in a parallel relationship to the side plates 64, 66 in a manner that enables the strip material 12 to be centered in the accumulator loop area 78, as well as to provide lateral support to the strip material 12 as it travels through the accumulator loop area 78. The geometric configuration of the guide plates 154 is such that the guide plates 154 extend along the entire length of the accumulator loop area 78.

Figure 4:
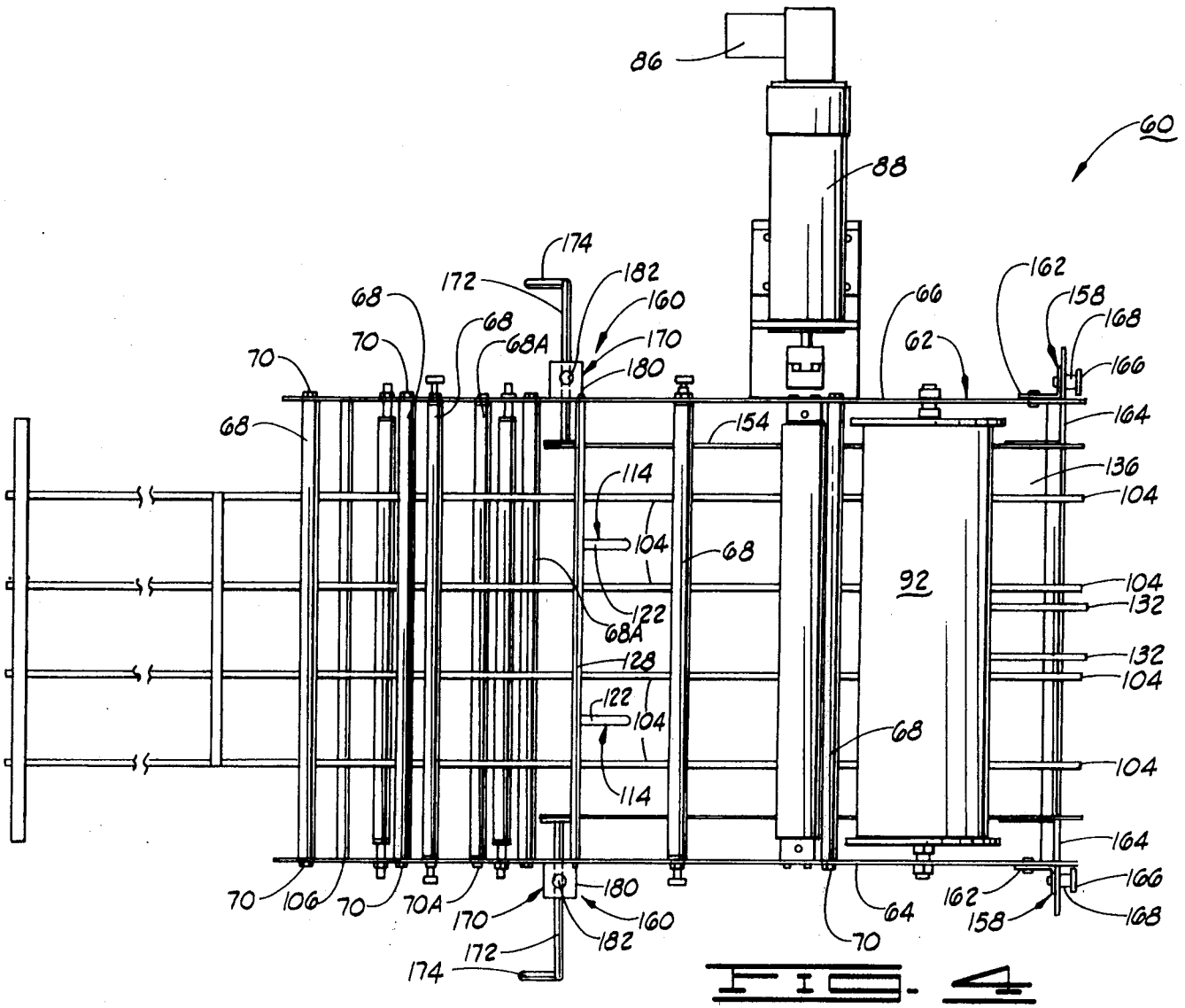
FIG. 4 is a top plan view of the accumulator assembly of the present invention.

As more clearly shown in FIG. 4, each of the guide plates 154 is slidably mounted between the side plates 64 and 66 by bracket assemblies 158, 160 so that the guide plates 154 can be selectively moved in and out to accommodate different widths of strip material 12. The bracket assemblies 158, which connect the upstream end of each of the guide plates 154 to the frame 62, include a first bracket member 162 and a second bracket member 164. The first bracket member 162 is an L-shaped member secured to the adjacent side plates 64, 66 and is adapted to rotatably receive an adjustment knob 166 which is provided with a screw threaded shaft 168. The second bracket member 164, which is provided with a horizontally oriented slot (not shown), is attached to the guide plates 154. The horizontally oriented slot (not shown) is dimensioned to slidably receive the threaded shaft 168 of the adjustment knob 166. The adjustment knob 166 secures the second bracket member 164 in a selected position when the adjustment knob 166 is tightened and permits the guide plates 154 to be slidably positioned when the adjustment knob 166 is loosened, as described below.

The downstream end of each of the guide plates 154 is supported by one of the bracket assemblies 160. Each of the bracket assemblies 160 includes a bracket member 170 connected to the downstream end of one of the guide plates 154. The bracket members 170 are provided with an opening (not shown) so that the bracket members 170 can slidably move over the rod member 128 of the feed guide 114.

Each of the bracket assemblies 160 further includes a control lever 172 that permits the operator to slidably position the guide plates 154. The control lever 172 is rigidly connected to each of the guide plates 154 such that the control lever 172 extends outwardly therefrom. An opening (not shown) is disposed in the adjacent side plates 64, 66 through the control lever 172 is slidably disposed. Thus, the guide plates 154 can be selectively positioned by pushing or pulling the control lever 172 until the desired position of the guide plates 154 is achieved. To facilitate the positioning of the guide plates 154, the control lever 172 is provided with a handle portion substantially as shown in FIG. 3.

To secure the guide plates 154 in a stable position, the control lever 172 extends through a box-like support bracket 180 mounted on the exterior of the side plates 64, 66. The support bracket 180 functions to support the control lever 172 and an adjustment knob 182. The adjustment knob 182 has a threaded shaft (not shown) matable with internal threads in the support bracket 180 which allows the end of the threaded shaft to selectively engage the control lever 172 and thereby secure the guide plates 154 in the desired position.

In the operation of the accumulator assembly 60, the strip material 12 is fed between the lower and upper rollers 82, 84 of the pinch roller assembly 80 by raising the upper roller 84 with the hand lever 85. After the strip material 12 has been fed between the lower and upper rollers 82, 84, the upper roller 84 is lowered so that the lower and upper rollers 82, 84 engage the strip material 12 positioned therebetween. The strip material 12 is then fed into the guide assembly 94 by jogging the pinch roller assembly 80. While the strip material 12 is fed through the guide assembly 94, the feed guide 114 of the lower guide subassembly 98 is secured in the lowered position by the indexing pin 130. Thus, the strip material 12 is directed to the downstream processing equipment via the travel path defined by the upper guide subassembly 96 and the lower guide subassembly 98. When the strip material 12 has been fed through the guide assembly 94, the feed guide 114 is moved to its raised position an secured by the indexing pin 130.

With the strip material 12 fed through the accumulator assembly 60 and the feed guide 114 secured in the raised position, the pinch roller assembly 80 is again jogged until the accumulation loop 12A of the strip material 12 is formed in the accumulation loop area 78. The strip material 12 is then centered in the accumulator loop area 78 with the guide plates 154. When the accumulation loop 12A of the strip material 12 is present in the accumulation loop area 78, the no-loop receiver 148 is not illuminated. However, the low set-point receiver 140 and the high set-point receiver 144 may or may not be illuminated depending upon the length of the accumulation loop 12A present in the accumulation loop area 78. That is, the illumination of the low and high set-point receivers 140, 144 will depend on whether such receivers are blocked due to the length of the accumulation loop 12A of the strip material 12 in the accumulation loop area 78. For example, the low and high set-point receivers 140, 144 will both be illuminated when the accumulation loop 12A is too short; neither the low and high set-point receivers 140, 144 will be illuminated when the accumulation loop 12A is too long; and the high set-point receiver 144 will not be illuminated when the accumulation loop 12A is of a desired length and between the upper and lower bounds set by the placement of the low and high set-point receivers 140 and 144.

As previously stated, the lower roller 82 of the pinch roller assembly 80 is driven by the variable speed motor 86 (see FIGS. 1, 3 an 4). Thus, the speed of the motor 86 can be controlled using a conventional motor controller (not shown) setable by signals received from the no-loop receiver 148, the low set-point receiver 140 and the high set-point receiver 144.

The accumulator assembly 60 of the present invention permits repetitive checks to be made on the length of the accumulation loop 12A of the strip material 12 in the accumulation loop area 78 of the accumulator assembly 60 and for adjusting the speed at which the strip material 12 is fed to the accumulator assembly 60. Thus, if the size of the accumulation loop 12A of the strip material 12 in the accumulation loop area 78 is between desired limits, the feed rate of the strip material 12 to the accumulator assembly 60 can be set at a base speed by setting the speed of the motor 86. However, if the accumulation loop 12A of the strip material 12 in the accumulation loop area 78 becomes too long, the feed rate of the strip material 12 to the accumulator assembly 60 can be reduced by slowing the speed of the motor 86. On the other hand, if the accumulation loop 12A of the strip material 12 in the accumulation loop area 78 becomes too short, the feed rate of the strip material 12 to the accumulator assembly 60 can be increased by increasing the speed of the motor 86.

From the above description it is clear that the accumulator assembly 60 of the present invention is well adapted to carry out the objects and to attain the ends and advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A vertical uncoiling apparatus for providing strip material to downstream processing equipment comprising:

frame means for supporting and selectively removing strip material from a coil of strip material;

accumulator means for receiving strip material from the frame means and delivering the strip material to downstream processing equipment, the accumulator means having an accumulation loop area defining a substantially S-shaped travel path for the strip material, the accumulator means comprising feed means for feeding strip material from the coil of strip material into the accumulation loop area so that a steady state flow of substantially tension-free strip material can be delivered to downstream processing equipment; and wherein the coil of strip material is vertically disposed on the frame means, and wherein the frame means comprises:

a base frame;

a turntable connected to the base frame and adapted to supportingly receive one or more coils of strip material;

a power source connected to the turntable for imparting rotational movement to the turntable and pay off of the coils of strip material supported thereon; and a mast and boom assembly supported by the frame means for providing transition of the strip material during pay off from a vertical plane orientation to a horizontal plane orientation prior to passage to the feed means of the accumulator means, the mast and boom assembly comprising:

a mast;

a boom collar slidably connected to the mast;

a first boom arm connected to the boom collar, the first boom arm having a first end portion and a second end portion;

a vertical idler roller connected to the first end portion of the first boom;

a first horizontal idler roller connected to the first end portion of the first boom so as to be disposed in a spatial relationship with the vertical idler roller;

a second horizontal idler roller connected to the second end portion of the first boom so as to be substantially aligned with the first horizontal idler roller;

a second boom arm connected to the first boom arm such that a distal end of the second boom arm extends outwardly from the first boom arm; and a plurality of centering discs connected to the distal end thereof such that the centering discs are positioned over the turntable and extend into the uppermost coil of strip material supported on the turntable.

2. The vertical uncoiling apparatus of claim 1 wherein the mast and boom assembly further comprises:

a chain and sprocket assembly connected to the boom collar; and power means connected to the chain and sprocket assembly for adjusting the height of the first boom arm.

3. The vertical uncoiling apparatus of claim 2 wherein the accumulator means further comprises:

an accumulator frame having a pair of spatially disposed sidewalls connected to a plurality of transversely disposed cross members;

support means connected to the sidewall for maintaining the sidewalls in a substantially parallel relationship; and guide means supported between the sidewalls so as to be substantially aligned with the feed means and downstream processing equipment, the guide means defining the substantially S-shaped travel path for the strip material, the guide means comprising:

an upper guide subassembly having a first outer guide and a first inner guide, the first outer and inner guides having a substantially J-shaped configuration and cooperating to define a J-shaped slot therebetween, the J-shaped slot constituting an upper portion of the substantially S-shaped travel path for the strip material; and a lower guide subassembly having a second inner guide, a base guide and a pivotally mounted feed guide selectively movable between a lowered position and a raised position, the second inner guide having a substantially J-shaped configuration and disposed in an abutting relationship with one end of the first inner guide such that when the feed guide is in its lowered position the feed guide cooperates with the second inner guide to define a portion of a lower portion of the substantially S-shaped travel path for the strip material, whereas when the feed guide is in the raised position the strip material in the lower of the substantially S-shaped travel path selectively moves back and forth along the accumulation loop area in response to material demands of downstream processing equipment.

4. The vertical uncoiling apparatus of claim 3 wherein the sidewalls of the accumulator frame are provided with a viewing slot and wherein the accumulator means further comprises:

guide plate means disposed between the sidewalls of the accumulator frame for providing lateral support to the strip material as same travels through the accumulation loop area, the guide plate means extending from the second inner guide of the lower guide assembly to an upstream end portion of the accumulator frame.

5. The vertical uncoiling apparatus of claim 4 wherein the accumulator means further comprises:

means for slidably mounting the guide plate means between the sidewalls of the accumulator frame so that the guide plate means can be adjusted to accommodate strip material of varying widths.

6. The vertical uncoiling apparatus of claim 5 wherein the guide plate means comprises a pair of guide plates slidably disposed between the sidewalls of the accumulator frame, each of the guide plates having a view slot form therein which is aligned with the viewing slot of the adjacently disposed sidewall of the accumulator frame.

7. The vertical uncoiling apparatus of claim 6 further comprising:

means for detecting the presence and length of a loop of the strip material in the accumulation loop area and for providing a signal to the feed means so as to control the feed rate of the strip material to the accumulator means.

8. An accumulator assembly for providing a tension-free steady state supply of strip material to downstream processing equipment comprising:

a frame having a pair of spatially disposed sidewalls connected to a plurality of transversely disposed cross members;

support means connected to the sidewall for maintaining the sidewalls in a substantially parallel relationship with each other; and guide means supported between the sidewalls so as to be substantially aligned with downstream processing equipment, the guide means defining substantially S-shaped travel path for the strip material;

feed means for feeding strip material into the guide means such that a substantially steady state of tension-free strip material is delivered to downstream processing equipment; and wherein the guide means comprises:

an upper guide subassembly having a first outer guide and a first inner guide, the first outer and inner guides having a substantially J-shaped configuration and cooperating to define a J-shaped slot therebetween, the J-shaped slot constituting an upper portion of the substantially S-shaped travel path for the strip material; and a lower guide subassembly having a second inner guide, a base guide and a pivotally mounted feed guide selectively movable between a lowered position and a raised position, the second inner guide having a substantially J-shaped configuration and disposed in an abutting relationship with one end of the first inner guide such that when the feed guide is in its lowered position the feed guide cooperates with the second inner guide to define a portion of a lower portion of the substantially S-shaped travel path for the strip material, whereas when the feed guide is in the raised position the strip material in the lower of the substantially S-shaped travel path selectively moves back and forth along the accumulation loop area in response to material demands of downstream processing equipment.

9. The accumulator assembly of claim 8 wherein the sidewalls of the frame are provided with a viewing slot and wherein the accumulator assembly further comprises:

guide plate means disposed between the sidewalls of the frame for providing lateral support to the strip material as same travels through the accumulation loop area, the guide plate means extending from the second inner guide of the lower guide subassembly to an upstream end portion of the frame.

10. The accumulator assembly of claim 9 further comprising:

means for slidably mounting the guide plate means between the sidewalls of the accumulator frame so that the guide plate means can be adjusted to accommodate strip material of varying widths.

11. The accumulator assembly of claim 10 wherein the guide plate means comprises a pair of guide plates slidably disposed between the sidewalls of the frame, each of the guide plates having a view slot form therein which is aligned with the viewing slot of the adjacently disposed sidewalls of the frame.

12. The accumulator assembly of claim 11 further comprising:

means operably connected to the feed means for detecting the presence and length of a loop of the strip material in the accumulation loop area and for controlling the feed rate of the strip material to the accumulator assembly via the feed means.

13. A vertical uncoiling apparatus for providing strip material to downstream processing equipment comprising:

frame means for supporting and selectively removing strip material from a coil of strip material, the frame means comprising:

a base frame;

a turntable connected to the base frame and adapted to supportingly receive one or more vertically disposed coils of strip material;

a power source connected to the turntable for imparting rotational movement to the turntable and pay off of the coils of strip material supported thereon; and means for transitioning the strip material during pay off from a vertical plane orientation to a horizontal plane orientation; and accumulator means for receiving strip material from the frame means and delivering the strip material to downstream processing equipment, the accumulator means having an accumulation loop area defining a substantially S-shaped travel path for the strip material to form an accumulation loop, the accumulator means comprising feed means for feeding the strip material paid from the coil of strip material into the accumulation loop area so that a steady state flow of substantially tension-free strip material can be delivered to the downstream processing equipment, the accumulator means further comprising: an accumulator frame having a pair of spatially disposed sidewalls connected to a plurality of transversely disposed cross members;

support means connected to the sidewall for maintaining the sidewalls in a substantially parallel relationship; and guide means supported between the sidewalls so as to be substantially aligned with the feed means and downstream processing equipment, the guide means defining the substantially S-shaped travel path for the strip material, the guide means comprising:

an upper guide subassembly having a first outer guide and a first inner guide, the first outer and inner guides having a substantially J-shaped configuration and cooperating to define a J-shaped slot therebetween, the J-shaped slot constituting an upper portion of the substantially S-shaped travel path for the strip material; and a lower guide subassembly having a second inner guide, a base guide and a pivotally mounted feed guide selectively movable between a lowered position and a raised position, the second inner guide having a substantially J-shaped configuration and disposed in an abutting relationship with one end of the first inner guide such that when the feed guide is in its lowered position the feed guide cooperates with the second inner guide to define a portion of a lower portion of the substantially S-shaped travel path for the strip material, whereas when the feed guide is in the raised position the strip material in the lower of the substantially S-shaped travel path selectively moves back and forth along the accumulation loop area in response to material demands of downstream processing equipment.

14. The vertical uncoiling apparatus of claim 13 wherein the sidewalls of the accumulator frame are provided with a viewing slot and wherein the accumulator means further comprises:

guide plate means disposed between the sidewalls of the accumulator frame for providing lateral support to the strip material as same travels through the accumulation loop area, the guide plate means extending from the second inner guide of the lower guide subassembly to an upstream end portion of the accumulator frame.

15. The vertical uncoiling apparatus of claim 14 wherein the accumulator means further comprises:

means for slidably mounting the guide plate means between the sidewalls of the accumulator frame so that the guide plate means can be adjusted to accommodate strip material of varying widths,

16. The vertical uncoiling apparatus of claim 15 wherein the guide plate means comprises a pair of guide plates slidably disposed between the sidewalls of the accumulator frame, each of the guide plates having a view slot form therein which is aligned with the viewing slot of the adjacently disposed sidewall of the accumulator frame.

* * * * *